US006530704B2

(12) United States Patent
Omura

(10) Patent No.: US 6,530,704 B2
(45) Date of Patent: Mar. 11, 2003

(54) PLATEN MECHANISM, A PRINTING DEVICE WITH THE PLATEN MECHANISM, AND A METHOD OF CONTROLLING THE PRINTING DEVICE

(75) Inventor: Kunio Omura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/847,366

(22) Filed: May 3, 2001

(65) Prior Publication Data

US 2001/0016137 A1 Aug. 23, 2001

Related U.S. Application Data

(62) Division of application No. 09/249,397, filed on Feb. 12, 1999, now Pat. No. 6,261,008.

(30) Foreign Application Priority Data

Feb. 12, 1998 (JP) ..... 10-29413

(51) Int. Cl.[7] ..... B41J 11/20
(52) U.S. Cl. ..... 400/58; 400/649
(58) Field of Search ..... 400/55, 56, 58, 400/642, 643, 648, 649, 653, 654, 655, 656, 657, 658, 659, 662, 708, 708.1; 101/93.04, 93.05

(56) References Cited

U.S. PATENT DOCUMENTS

| | | | | |
|---|---|---|---|---|
| 4,373,438 A | | 2/1983 | Arai | |
| 4,556,333 A | | 12/1985 | Stefansson | |
| 4,768,894 A | | 9/1988 | Suzaki et al. | |
| 4,867,058 A | | 9/1989 | Luckhurst | |
| 5,043,741 A | * | 8/1991 | Spehrley, Jr. | 346/99 |
| 5,316,395 A | | 5/1994 | Imai | |
| 5,547,292 A | * | 8/1996 | Harada | 347/80 |
| 5,865,547 A | * | 2/1999 | Harris et al. | 271/225 |
| 5,893,667 A | | 4/1999 | Kinney et al. | |
| 5,997,192 A | * | 12/1999 | Martinez et al. | 235/449 |

FOREIGN PATENT DOCUMENTS

| | | |
|---|---|---|
| EP | 0 604 144 | 6/1994 |
| JP | 64-58576 | 3/1989 |
| JP | 5-124274 | 5/1993 |
| JP | 8-11365 | 1/1996 |

OTHER PUBLICATIONS

Patent Abstract of Japan, vol. 1998, No. 3, Feb. 27, 1998 and JP 09 286148 (TEC Corp.), Nov. 4, 1997.
Patent Abstract of Japan, vol. 013, No. 545 (M–902), Dec. 6, 1989 and JP 01 226364 (NEC Data Terminal Ltd.), Sep. 11, 1989.

* cited by examiner

*Primary Examiner*—Ren Yan
(74) *Attorney, Agent, or Firm*—Nixon & Vanderhye P.C.

(57) ABSTRACT

An apparatus and method technique to secure a smooth transporting of a recording medium in a printing device of the type in which a gap between the print head and the platen is included in a transport path for another purpose, e.g., reading of magnetic ink character recognition (MICR) characters on the recording medium, through use of a platen which is rotatable between two positions: a support position and a guide position, and which minimizes the gap adjacent the platen in the guide position.

18 Claims, 14 Drawing Sheets

PLATEN MECHANISM, A PRINTING DEVICE WITH THE PLATEN MECHANISM, AND A METHOD OF CONTROLLING THE PRINTING DEVICE

This is a divisional of application Ser. No. 09/249,397, filed Feb. 12, 1999, now U.S. Pat. No. 6,261,008, the entire content of which is hereby incorporated by reference in this application.

The present invention relates to printing devices and more particularly to printing devices with a platen mechanism, and a method of controlling the printing device.

BACKGROUND OF THE INVENTION

In printing devices, such as impact printers, the gap between the print heat and the platen is one of the key factors that determine print quality. If the gap is too large, the print head loses its proper distance for printing on the surface of a printing sheet. This results in blur and deformation of printed characters. With ink jet printers, if the gap is excessively large, an error of the ink drop arrival position caused by an error of the ejecting angle is enlarged, so that the print quality is also deteriorated. For this reason, to secure a high print quality, the platen-to-print head gap should be reduced by locating the platen as close to the print head as possible in a state that the platen is opposite the print head.

Typically, a printing sheet is transported from the sheet supply side to a printing region by a transporting mechanism, such as rollers, through a sheet transport path. The height of the inner space within the transport path is large enough to allow the printing sheet to smoothly move therethrough, thereby preventing the sheet form being jammed in the transport path. Accordingly, the printing sheet must be inserted in a narrower gap in the printing region form the large enough transport path. As a result, the leading edge of the sheet hits the platen or a member near to it, possibly causing a paper jam.

One technique to solve the problem is known. This conventional, prior art platen mechanism is illustrated in FIGS. 8 to 10. As shown, a platen 81 is disposed opposite a print head 80, which is horizontally movable. The platen 81 consists of a plate-like member having a length corresponding to a movable range of the print head 80. The platen 81 is fastened to a support member 83, which may be turned about a shaft 82. The support member 83 is mechanically coupled with a solenoid plunger 84. When driven by the plunger 84, the support member 83 and hence the platen 81 are moved to and from the print head 80.

In a print mode of the printer, the platen 81 is moved toward the print head 80 and its end face is positioned in a sheet transport path 85. Accordingly, a reduced gap G is set up between the platen 81 and the print head 80 (FIG. 9).

In a sheet insertion mode of the printer in which a sheet is inserted into a printing region (including a portion of the transport path 85 located between the platen 81 and the print head 80), the platen 81 is retracted from the transport path 85, and hence its end face is moved apart from the print head 80 and the gap G is increased. Under this condition, the printing sheet P may enter the printing location smoothly or without any interruption.

This conventional platen mechanism suffers from problems. In operation, the entirety of the combination of the platen 81 and the support member 83 is pivoted by the plunger 84. To keep the gap G constant when the printer is in the print mode, exactness is required for the dimensions of the related parts. In addition, a large space if required between the opening of the transport path 85 and the platen 81. The moving sheet is frequently caught by the large space, resulting in a paper jam. Finally, the platen 81 needs to be stable when it receives an impact from the print head 80. To this end, the output power of the plunger 84 must be large.

Another prior art platen mechanism is disclosed in JP-A-8-11365. In the prior art, the gap between the print head and the platen is adjusted such that the gap is increased in the sheet insertion mode, and decreased in the print mode. An eccentrically mounted cylindrical platen is rotated to adjust the gap.

In a design where the eccentrically mounted cylindrical platen protrudes beyond the guide wall defining the transport path, the radius of the movement of the cylindrical platen is larger than that of the platen per se, so that a large gap is created between the platen and the guide wall. This large gap can easily catch the leading edge of the printing sheet, causing a paper jam.

There are cases where the leading edge of the printing sheet merely hits the guide wall portion defining the gap, not causing a paper jam. In this case, the transporting speed of the printing sheet is varied. Therefore, when the printer engages in reading information on the sheet or Magnetic Ink Character Recognition (MICR) characters, the speed variation appears as read errors.

SUMMARY OF THE INVENTION

The present invention aims at providing a platen mechanism in use with a printing device which, in the print mode, keeps the gap in the printing region constant, and, in the sheet insertion mode, allows a sheet to smoothly pass the gap without any adverse effect on the sheet transporting speed.

A platen mechanism, disposed opposite a print head, is provided for supporting a recording medium. The platen mechanism includes a guide wall for guiding the recording medium to the print head, a platen which is rotatable about a shaft substantially parallel to the guide wall and has a support portion and a guide portion. When the rotating platen is stopped at a first position where the support portion is opposite the print head, the support portion projects from the guide wall to support the recording medium to the print head. When the rotating platen is stopped at a second position where the guide portion is opposite the print head, the guide portion is substantially continuous to the guide wall to smoothly guide the recording medium being transported. A platen drive mechanism rotates the platen so that the support portion or the guide portion selectively confronts the print head.

With such a mechanical arrangement, when the printing device is in a print mode, the platen is turned to confront the support portion of the platen with the print head, and it serves as a platen. In this case, a force applied from the print head (such as a dot matrix or other impact print head) to the platen may be received by the rotary shaft of the platen. In accordance with the present invention, the platen is immovable and stable printing is ensured. When the printing device is in a medium transporting mode, the recording medium passes through a printing region (including a portion of the transport path located between the platen and the print head), the platen is turned to confront the guide portion of the platen with the print head. In this case, the guide portion is substantially continuous to the guide wall, so that the recording medium being transported is smoothly guided. The result is to prevent a variation of the transporting speed of the recording medium.

The platen mechanism may comprise an urging member which urges the recording medium apart from the print head and supports the recording medium at a predetermined distance from the print head in cooperation with the support portion of the platen. In this case, the guide portion of the platen is preferably positioned apart from the urging member when the guide portion is opposite the print head. With the additional feature, in the print mode, the distance between the recording medium and the print head can be kept constant. Therefore, in the ink jet printer, for example, print quality deterioration caused by a print position variation that is due to the ejecting angle error of the ink drop is eliminated. In the medium transporting mode, the urging member is separated from the guide portion of the platen to open and to provide a large sheet transporting path. Therefore, the recording medium advances without any collision and hence is free from the transporting speed variation caused by the collision of the recording medium. In the platen mechanism, when the guide portion is opposite the print head, the guide portion of the platen matches the ends of the guide wall. The guide portion of the platen is disposed with respect to the guide walls. A minimum gap is present between each end of the guide portion and the end of the corresponding guide wall. The minimum gap allows the platen to move angularly. With this unique mechanical feature, there is less chance that the recording medium hits the guide portion of the platen, and hence the medium transportation speed is not varied.

In the platen mechanism, the platen includes an introducing surface for introducing the recording medium from the end of the guide wall to the support portion when the support portion confronts the print head. Use of the introducing surface, allows the recording medium to smoothly pass through the printing region in a print ready state (the support portion of the platen confronts the print head), where a variation of the transporting speed of the recording medium offers no problem.

In one embodiment, a printing device can comprise a pair of rollers for transporting the recording medium when the print head prints on the recording medium, a roller-pair drive mechanism for moving the paired rollers to and from each other, and an interlinking mechanism for mechanically linking the platen drive mechanism to the roller-pair drive mechanism such that when the platen drive mechanism moves the platen to the first position, the roller-pair drive mechanism moves the paired rollers to each other to bring them into contact with each other, and when the platen drive mechanism moves the platen to the second position, the roller-pair drive mechanism moves the paired rollers apart from each other.

The printing device reliably transports the recording medium in a print mode, and retracts the platen while at the same time moves the paired rollers out of the transport path. The printing device thus arranged realizes quick sheet processing, easy control and reduction of the number of required drive sources.

In an embodiment of the printing device, the platen drive mechanism can include a drive shaft, a clutch mechanism for intermittently transmitting a drive force from the drive shaft to the platen, and a trigger mechanism for setting up a coupling state of the clutch mechanism at a predetermined timing, and a decoupling state of the clutch mechanism in accordance with a predetermined quantity of rotation of the platen. These technical features enable the drive shaft to be used together with other mechanisms, such as a medium transporting mechanism. This results in reduction of the number of required drive sources, and hence reduction of the device size. The transportation of the recording medium and the securing of the transport path and the preparation for printing may be concurrently carried out, and therefore the sheet processing is quick.

In another embodiment of the invention a printing device includes a print head for printing on a recording medium, a detector for reading information on the recording medium, a sheet transporting mechanism for transporting the recording medium in front of the print head and the detector, and a guide wall for guiding the recording medium being transported by the transporting mechanism to the print head. A platen is disposed opposite the print head and movable to a first position where the support portion thereof is projected from the guide wall to support the recording medium to the print head, and to a second position where the guide portion thereof is substantially continuous to the guide wall to smoothly guide the recording medium being transported. A platen drive mechanism can drive the platen to move selectively to the first or second position. A controller controls the platen drive mechanism to move to the first position when printing on the recording medium by the print head, and to move to the second position when reading information by the detector.

The printing device thus constructed exactly sets the platen to predetermined positions in a print mode and a sheet transporting mode.

In such a printing device, the platen disposed confronting the print head is rotatable about a shaft substantially parallel to the guide walls and includes a support portion and a guide portion. When the rotating platen is at a first position where the support portion confronts the print head, the support portion is projected from the guide wall to support the recording medium to the print head. When the rotating platen is at a second position where the guide portion confronts the print head, the guide portion is substantially continuous to the guide wall to smoothly guide the recording medium being transported therethrough.

The combination of the controller and the platen completely removes a variation of the sheet transporting speed when information is read out of the recording medium.

The detector may be a magnetic head for reading information from the recording medium. The operation of reading the MICR characters is sensitive to the speed variation. Use of the magnetic head is very useful, in this respect. Other types of readers, such as optical character or magnetic stripe readers, can also be used.

The printing device may further comprise a command interpreter for interpreting a control command received from a host device connecting to the printing device, wherein the controller moves the platen to the second position when the command interpreter interprets a predetermined command to require the detector to read information. This arrangement secures a sheet transport path in preparation for the operation of reading information from the recording medium.

The invention further provides a method of controlling a printing device comprising the steps of: transporting a recording medium on and along guide walls, supporting the recording medium to a print head in a state that a platen is projected to a support position, printing on the recording medium by the print head, guiding the recording medium in a state that the platen is retracted to a guide position, reading information from the recording medium transported in the first step by use of a detector.

In this case, the control method may further comprise a step of interpreting a predetermined control command received from a host device connecting to the printing device and to require the reading of information on the recording medium, wherein the step of reading information from the recording medium is executed when the control command is interpreted in the step of interpreting the control command.

Other features and advantages will be readily apparent from the following detailed description, the accompanying drawings, and the claims.

DETAILED DESCRIPTION OF PREFERRED EMBODIMENTS

Figure 1:
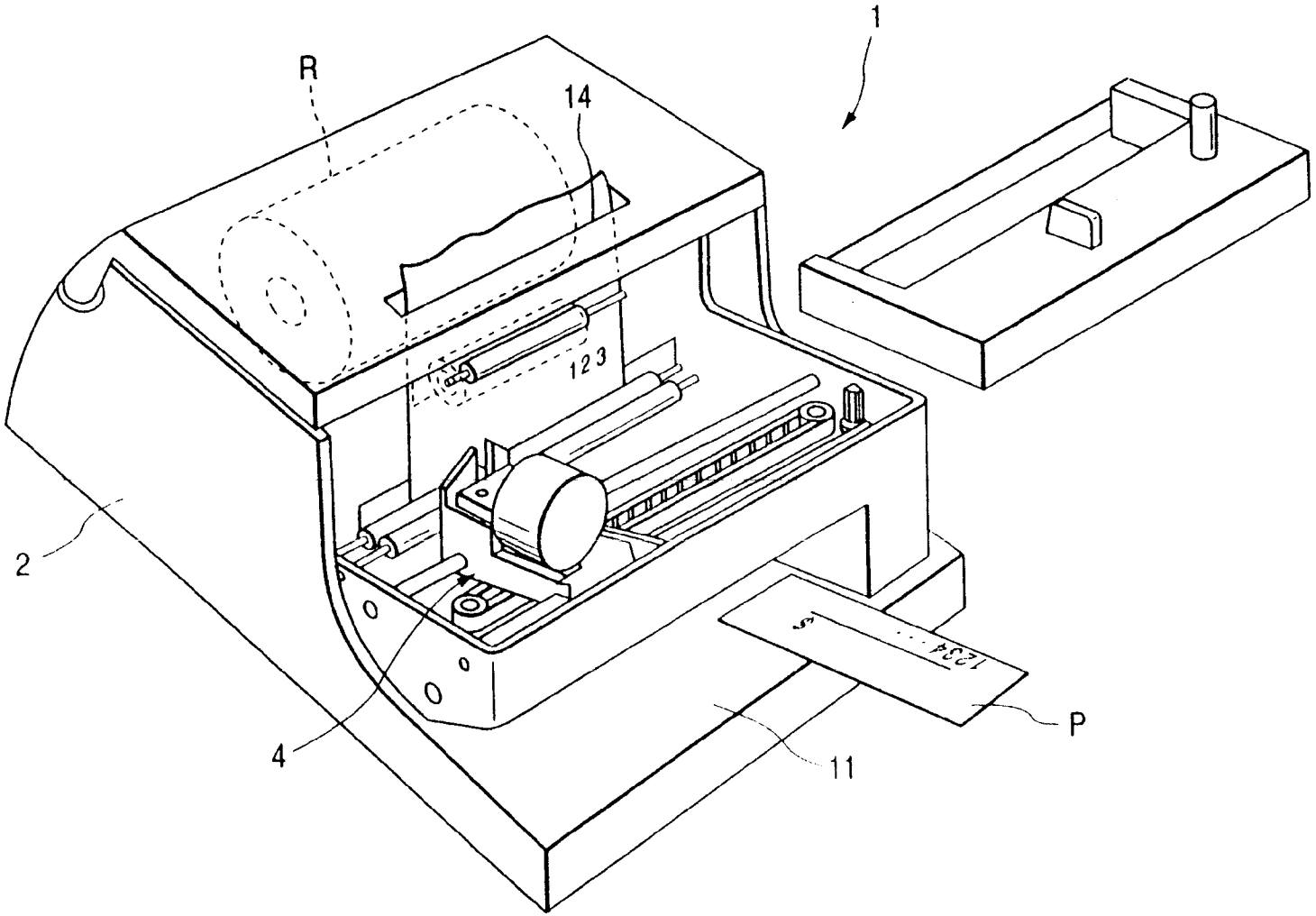
FIG. 1 illustrates a perspective view of a multi-functional imaging apparatus.
Figure 2:
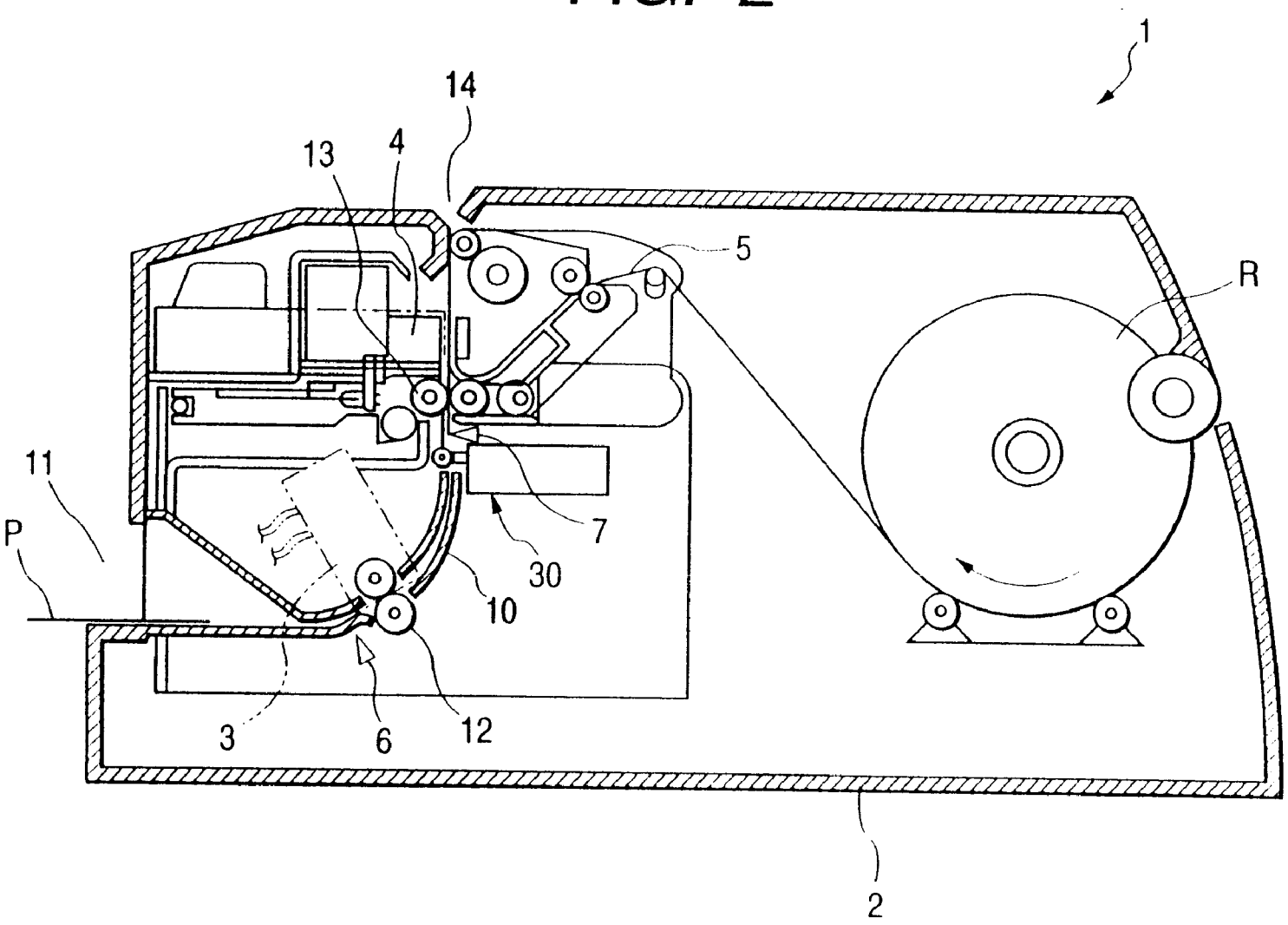
FIG. 2 illustrates a cross sectional view of the multi-functional imaging apparatus of FIG. 1.

FIG. 1 is a perspective view showing am multi-functional imaging apparatus with a printing device, which is constructed according to the present invention; and FIG. 2 is a cross sectional view of the multi-functional imaging apparatus of FIG. 1. The multi-functional imaging apparatus reads magnetic ink character recognition (MICR) characters, which are printed on a sheet, such as a personal check, and prints characters such as an endorsement in accordance with the readout result. It should be understood that the printing devices and platen mechanisms of the invention are not limited only to the multi-functional imaging apparatus, but are also applicable to other types of printing machines, such as monofunctional printing machines.

As shown, a multi-functional imaging apparatus 1 includes an information reading unit 3, a first printing unit 4 and a second printing unit 30, and those units are located within a housing 2. A sheet transport path (first transport path) 10 for continuously guiding a check sheet P extends from the front side of the multi-functional imaging apparatus 1 to the interior of the apparatus, and is curved upward within the apparatus 1. The information reading unit 3, the first printing unit 4, and the second printing unit 30 are disposed along the sheet transport path 10. The information reading unit 3 includes a magnetic head for reading information in the form of MICR characters that are printed on a surface of the check sheep P. The information may be, but is not limited to, codes indicative of the check validity, and the identification number and the validity time of the check. In accordance with the result of the reading operation by the information reading unit 3, the first printing unit 4 prints on the first side of the check sheet P and the second printing unit 30 prints on the reverse side of the check sheet P. The readout result is normally sent to a host machine, such as a POS terminal or an electric cash register (ECR), to which the multi-functional imaging apparatus 1 is coupled. The host machine judges if the check is valid, and returns the validity check result to the imaging apparatus. The imaging apparatus 1 operates the related printing unit or units for printing in accordance with the validity check result returned from the host.

The first printing unit 4 has another function to print on a roll paper R, set at a rear portion within the housing 2. The roll paper R is guided by a second transport path 5 and led to the first transport path 10 and to the first printing unit 4. When the check sheet P is set in an inlet port 11 of the first transport path 10, it is sensed by a first sheet-edge sensor 6, located upstream of a pair of rollers 12 (first roller pair). When sensing the sheet, the sensor 6 outputs a signal which will be used to drive the first roller pair 12. The check sheet P is transported at high speed by the first roller pair 12. The information reading unit 3 reads the information of the MICR characters from the moving check sheet P. A second sheet-edge sensor 7 senses the check sheet P when it reaches the second printing unit 30, and produces an output signal to the second printing unit 30. In response to the output signal, the second printing unit 30 prints on the reverse side oft he check sheet P in accordance with the print data received from the host. Upon completion of the reverse-side printing by the sxecond printing unit 30, the check sheet P is fed to the first printing unit 4 by means of a pair of rollers 13 (second roller pair). The first printing unit 4 prints on the obverse side of the check sheet P in accordance with the print data received from the host. The printed check sheet P is discharged out of the housing 2, through an exit 14.

Figure 3:
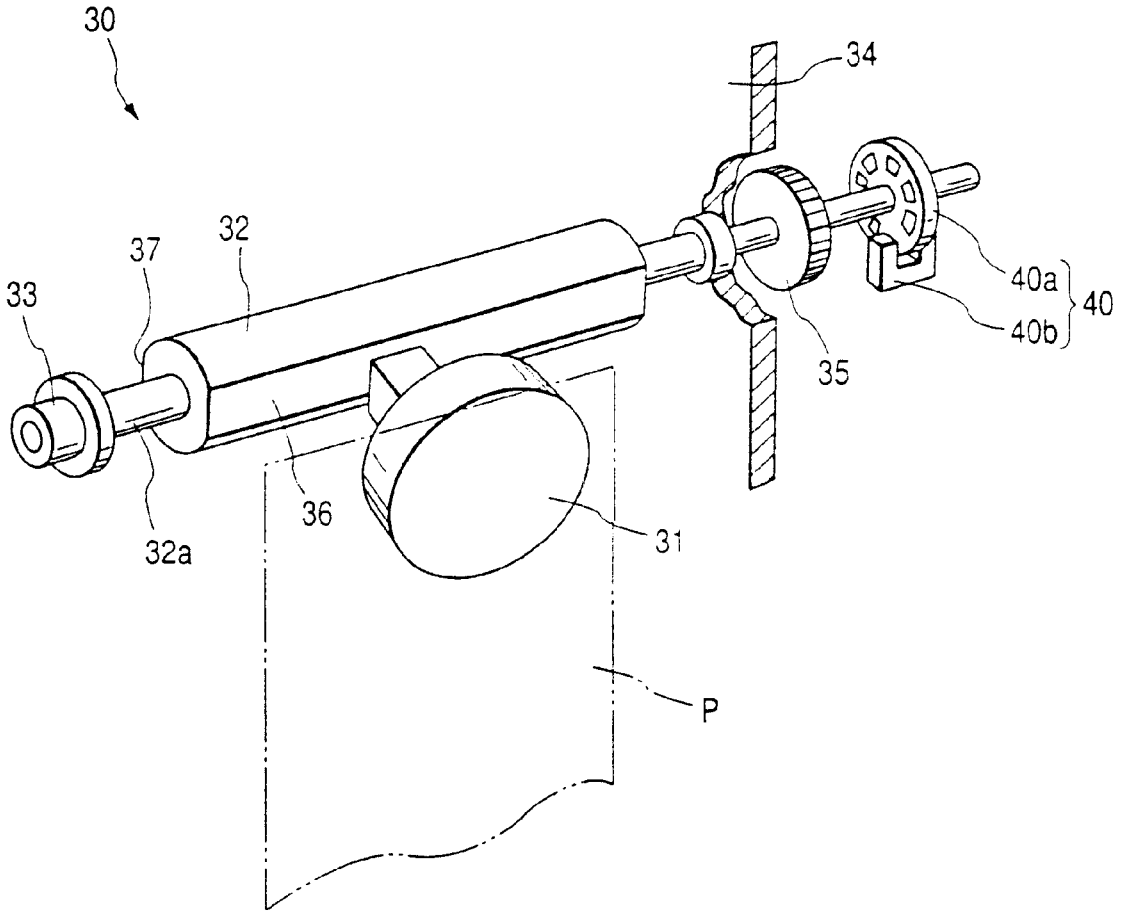
FIG. 3 illustrates an enlarged, perspective view of a platen mechanism incorporated into the second printing unit in the multi-functional imaging apparatus of FIG. 1.

FIG. 3 is an enlarged, perspective view schematically showing a key portion of the second printing unit 30. The second printing unit 30 includes a print head 31, which is movable in the widthwise directions of the check sheet P. The print head 31, which is of the dot impact type, prints characters and graphics in the form of dots congregated as intended.

The serial type print head is illustrated. In an implementation of the invention a shuttle print head is used. U.S. Pat. No. 4,373,438 is incorporated herein by reference. As explained in detail in that document, the shuttle print head simultaneously forms dots on and along a line on a platen 32, the line extending in parallel with the lengthwise direction of the platen. An ink ribbon of the detachable cartridge type (not shown) is disposed on the print head 31 to provide an ink ribbon without any slack in front of the print head 31. A mask plate 38 shown in FIG. 4 but not shown in this figure for pressing the check sheet P against the platen 32 is also used.

Figure 11:
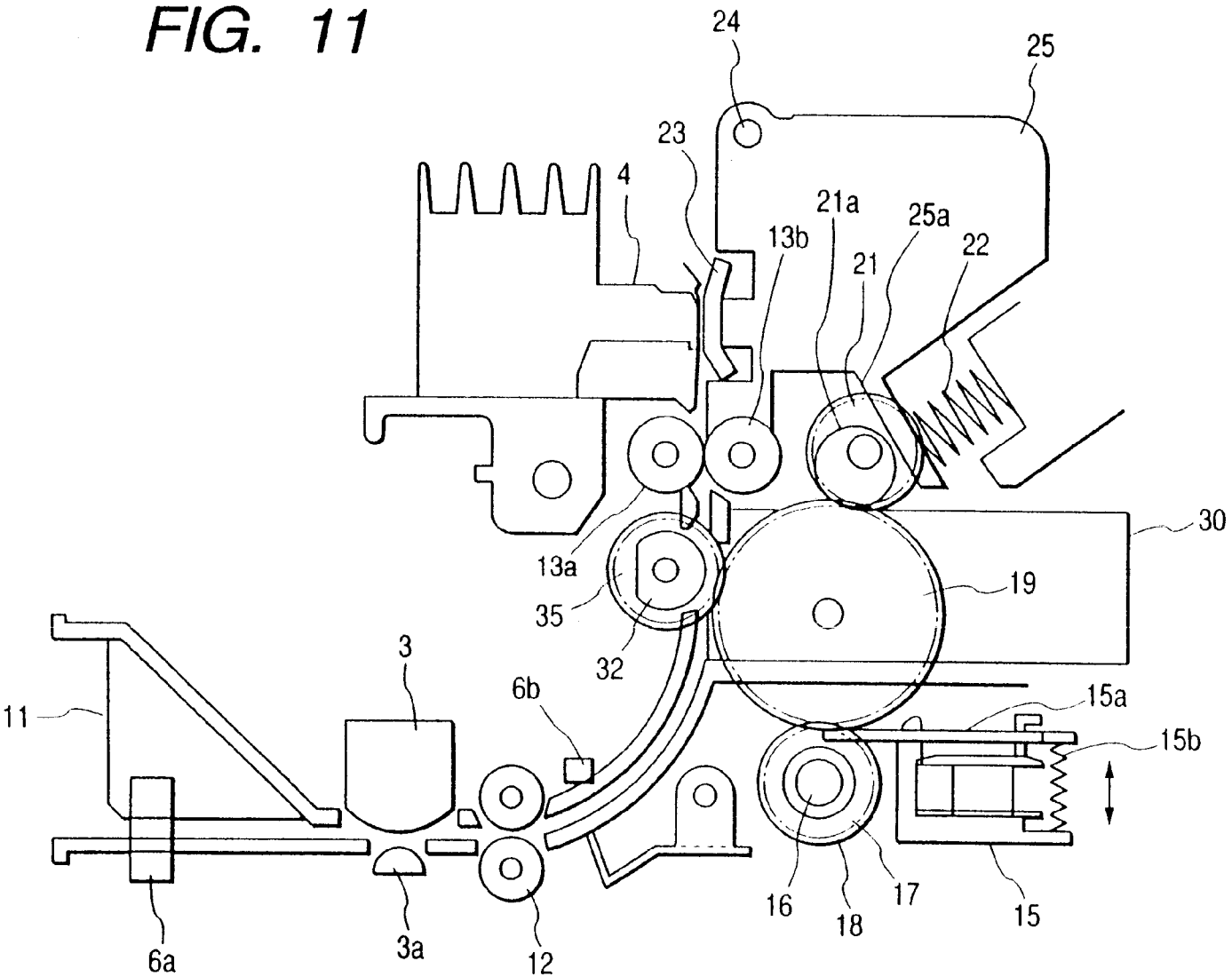
FIG. 11 illustrates a sectional view of a platen drive mechanism in the second printing unit of the multi-functional imaging apparatus.

The platen 32 is confronted with the print head 31. The platen consists substantially of a long, cylindrical member extended in the widthwise direction of the check sheet P. A shaft 32*a* passes through the platen 32 such that it is projected outward from both ends of the platen. Bearing members 33 are attached to both ends of the shaft 32*a*. The shaft 32*a* is supported at both ends by a frame 34 with the aid of the bearing members 33. The platen 32 is rotatably supported in front of the print head 31. The shaft 32*a* is parallel to guide walls 10*a* (or two portions of a guide wall 10*a*) (FIG. 4) defining the first transport path 10 and is also parallel to the moving directions of the print head 31. In the shuttle type print head, the moving direction of the print head 31 is coincident with the direction in which a pin array thereof forming a dot array is arranged. A gear 35 is firmly attached to one end (the right end in FIG. 3) of the shaft 32*a*. The gear is mechanically coupled to a drive source (not shown) via gear trains (FIG. 11). The gear receives a drive force from the drive source and transmits it to the platen 32, which in turn rotates.

The platen 32 has specially designed surfaces arranged in the longitudinal direction. Those surfaces are a support surface 36 and a guide surface 37 in the embodiment under discussion. With rotation of the platen 32, either the support surface 36 or the guide surface 37 faces the print head 31. The platen 32 has two stop positions. The positions are when either of the surfaces 36 and 37 is confronted with the print head 31.

Referring still to FIG. 3., a rotation angle detector 40 is provided for detecting an angular state of the platen 32. The rotation angle detector 40 consists of the combination of a rotary encoder 40*a* and a photo-interrupter 40*b*. The support surface 36 and the guide surface 37 are angularly spaced from each other by an angle of about 180 degrees. In FIG. 3, the platen 32 is positioned such that the support surface 36 looks toward this side, and the guide surface 37 looks toward the rear side and hence it is not illustrated.

Figure 4:
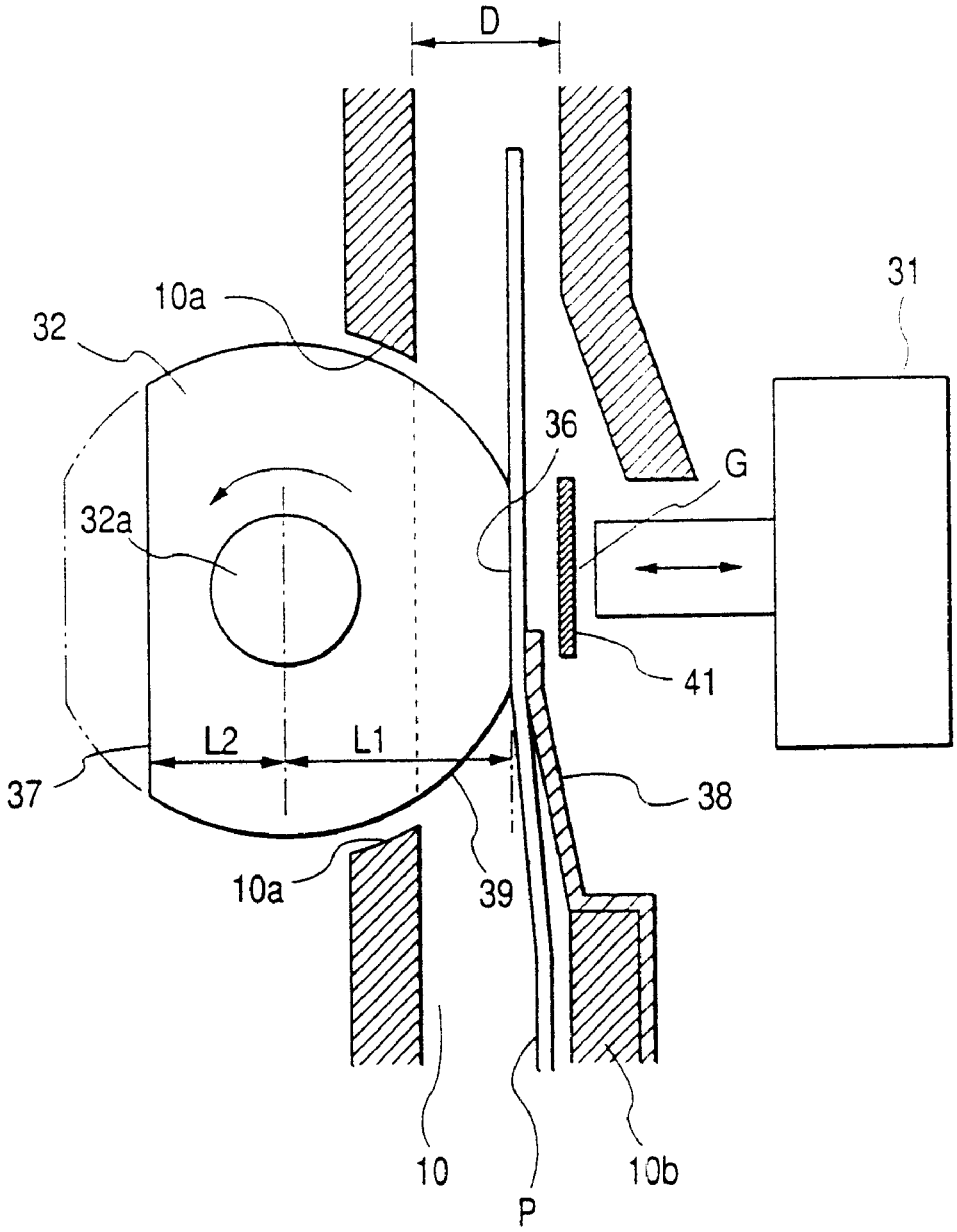
FIG. 4 illustrates a side view of a state of a platen mechanism when it is in a print mode.

Referring now to FIG. 4, sectional configuration of the platen 32, its position relative to the print head 31, and the first transport path 10 are illustrated. The print head 31 and the platen 32 are opposed to each other, and the guide walls 10*a* vertically extend above and below the platen 32. The guide wall 10*a* guides the check sheet P being transported. The support surface 36 and the guide surface 37, which are formed on the outer peripheral surface of the platen 32, are opposed to each other with respect to the axis of the platen. When the printing device prints on the check sheet P in a print mode, the platen 32 is turned to place the support surface 36 opposite the print head 31, and the support surface 36 comes in contact with and supports the back side of the check sheet P. In this state, the print head 31 prints on the check sheet P. An ink ribbon 41 is located between the print head 31 and the check sheet P. An elastic member 38 such as a mask plate is provided. The elastic member brings the check sheet P into close contact with the support surface 36 of the platen 32 in order to keep the distance between the print head 31 and the check sheet P proper. The elastic member 38 is mounted on the guide wall 10*b* which is located close to the print head and forms the first transport path 10. When the check sheet P is absent, the elastic member 38 is in contact with the support surface 36 of the platen 32 to completely close the first transport path 10. The elastic member 38 may be formed with a plate spring. It may be extended in parallel with the platen 32, and preferably arranged so as to move together with the print head 31.

Figure 12:
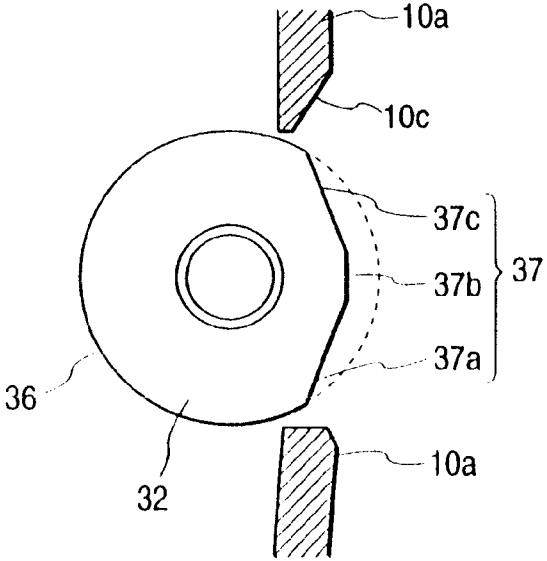
FIG. 12 illustrates a cross sectional view of a platen.

A distance L1 between the center of rotation of the platen 32 and the support surface 36 of the platen 32 is selected so as to provide a proper gap (for example, 0.6 mm to 0.9 mm) between the support surface 36 and a tip of the print head 31. In this instance, the support surface 36 is substantially flat, however, it may take nay other suitable shape. Where the shuttle print head is used, the support surface 36 may be curved as a part of the cylindrical surface with its center coincident with the shaft 32*a* of the platen 32 as shown in FIG. 12. In this case, if an angular position of the platen 32 is different from a preset one, the distance of the support surface 36 to the print head is always constant. Further, when a part of the support surface 36 is worn, a slight shift of the angular position of the platen 32 will replace the worn part with a normal part. Namely the angular position is slightly shifted, and another part, not worn, of the support surface 36 is used instead of the worn part.

To smoothly introduce the check sheet P into the support surface 36 of the platen 32, an introducing surface 39 is preferably provided continuous to the support surface 36, as shown in FIG. 4. With provision of the introducing surface 39, the check sheet P smoothly passes through the printing region even pushing the elastic member 38 away from the support surface 36 to create a gap therebetween if the guide surface 37 of the platen 32 is not confronted with the print head 31, in case where a variation of the transporting speed of the check sheet P offers no problem when the check sheet P is transported to the printing region, for example, for the printing purpose. Note that it is sufficient to provide the introducing surface 39 only in an upstream location in the transporting direction of the check sheet P.

Figure 5:
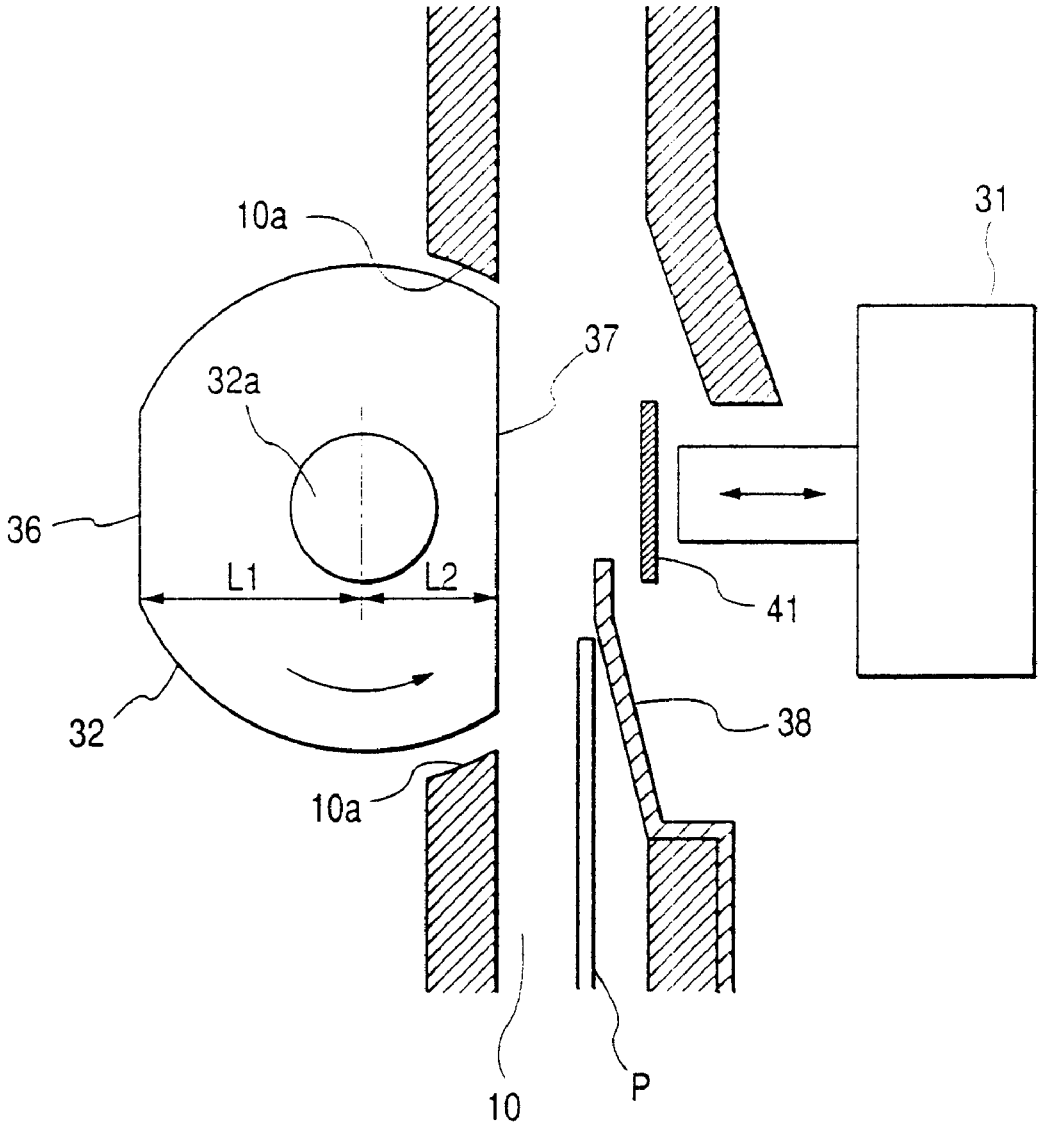
FIG. 5 illustrates a side view of a state of a platen mechanism when it is in a sheet transporting mode.

When the check sheet P passes through the printing region, in a sheet transporting mode, the platen 32 is turned and the guide surface 37 of the platen 32 confronts the print head 31. A distance L2 between the guide surface 37 and the center of rotation of the platen 32 is selected so that the guide surface 37 is substantially continuous to the surfaces of the guide walls 10*a* located close to the platen 32 when the guide surface 37 confronts the print head 31. When the guide surface 37 is substantially continuous to the surfaces of the guide walls 10*a*, the guide surface 37 forms a part of the guide wall in front of the print head 31. FIG. 5 shows a state of the platen mechanism when the guide surface 37 of the platen 32 confronts the print head 31, in the sheet transporting mode. The platen 32 is retracted from the transportation path 10, the space in front of the print head 31 is enlarged, and the platen 32 is detached from the elastic member 38. In this state, a smooth transportation of the check sheet P is ensured. Namely, when the check sheet P passes through the printing region, one side of the check sheet P facing the platen, is smoothly guided by the guide surface 37 of the platen 32, while the other side of the check sheet P facing the print head, is smoothly guided by the elastic member 38. Therefore, there is no chance that the check sheet P hits the platen 32, the print head 31 or the ink ribbon 41, which might cause its transporting speed to vary. A specific example of the platen mechanism is given below. The platen 32 is made of a metal and is 11 mm in diameter, 5 mm in L1 and 3 mm in L2, the gap G between the tip of the print head 31 and the platen in the print mode is 0.08 mm, a distance between the center of rotation of the platen 32 and the front end of the print head 31 is 5.8 mm, and the width D of the first transport path 10 is preferably within 2.5 to 3.0 mm.

Figure 14:
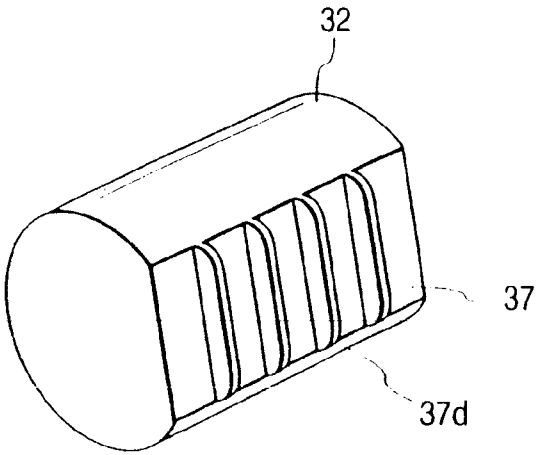
FIG. 14 illustrates a schematic perspective view of a platen.

A plural number of ridges 37*d* (FIG. 14), extending in the sheet transporting direction, may be formed on the surface of each guide wall 10*a* to prevent the check sheet P from sticking to the guide wall 10*a* by an electrostatic force. In this case, it is desirable to form ridges on the guide surface 37 of the platen 32 such that those ridges are continuous to the ridges of the guide wall surface when the platen 32 is turned and the guide surface 37 is flush with the guide walls 10*a* (FIG. 14).

As shown in FIGS. 4 and 5, the ends of the guide walls 10*a* are located in close proximity to the outer peripheral surface of the platen 32. Those ends match the outer peripheral surface of the platen. In this case, at least the ends of the guide surface 37 of the platen 32 need to match the ends of the guide walls 10*a*, and the entire outer peripheral surface of the platen does not need to match the ends of the guide walls 10*a*.

Figure 13:
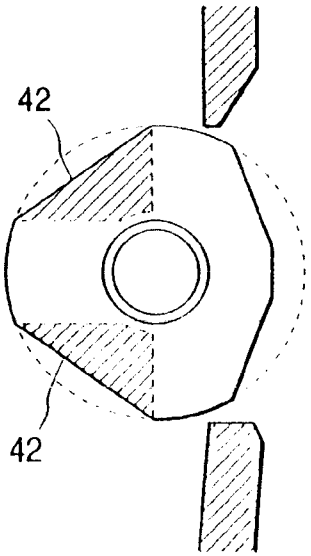
FIG. 13 illustrates a cross sectional view of a platen.

Referring now to FIG. 13, there is shown another example of the platen 32. In this example, the portions 42 of the outer peripheral surface of the platen, which are located between the support surface 36 and the guide surface 37, are substantially flat, not curved. The platen in this configuration has a reduced gyrating mass, so that a quick switch between the support surface 36 and the guide surface 37 is realized. The surface 42 is designed to be flat with such an intention that it also serves as an introducing surface 39. When the surface 42 does not need to have the function of the introducing surface, the slanted portions described with hatching may be removed from the platen. In this configuration, when the guide surface 37 of the platen 32 confronts the print head 31, the gap between each guide wall 10*a* and the guide surface 37 is reduced to the minimum. As a result, a stable transportation of the check sheet P is ensured.

In a specific example, this gap is about 0.2 mm. The outer peripheral surface of the platen 32, except those portions of the support surface 36 and the guide surface 37, are arcuate with respect to the center of rotation of the platen 32. Therefore, the radius of rotation of the platen 32 is maximized in the arcuate portions. Therefore, the gaps may be minimized in those portions. It is essential to minimize the gaps in particular when the check sheet P moves through the printing region, the guide surface 37 and the guide walls 10*a* (FIG. 5). By so doing, there is less chance that the leading edge of the check sheet P hits the gap or is caught by the gap, causing a variation of sheet transporting speed or a paper jam.

Referring now to FIG. 12., the guide surface 37 of the platen 32 is designed to have three faces 37*a*, 37*b* and 37*c*, which are in parallel with the shaft 32*a* of the platen 32. The design is made taking an angular position error of the platen 32 into account. With provision of the flat surface 37*a*, if the stop position of the platen 32 shifts in the counterclockwise direction, there is less chance that the platen turns into the first transport path 10 above the guide wall 10*a*. With provision of the flat surface 37*c*, if the stop position of the platen 32 shifts in the clockwise direction, there is less chance that the platen turns into the first transport path 10 above the level of the guide wall 10*a*. Those flat surface may be substituted by one curved surface. However, use of the combination of the flat faces is advantageous in that it is easily worked by use of a working machine, such as a milling machine. The guide wall 10*a* located downstream in the transporting direction of the check sheet P is preferably provided with a slanted surface 10*c* for guiding the check sheet P.

Figure 6:
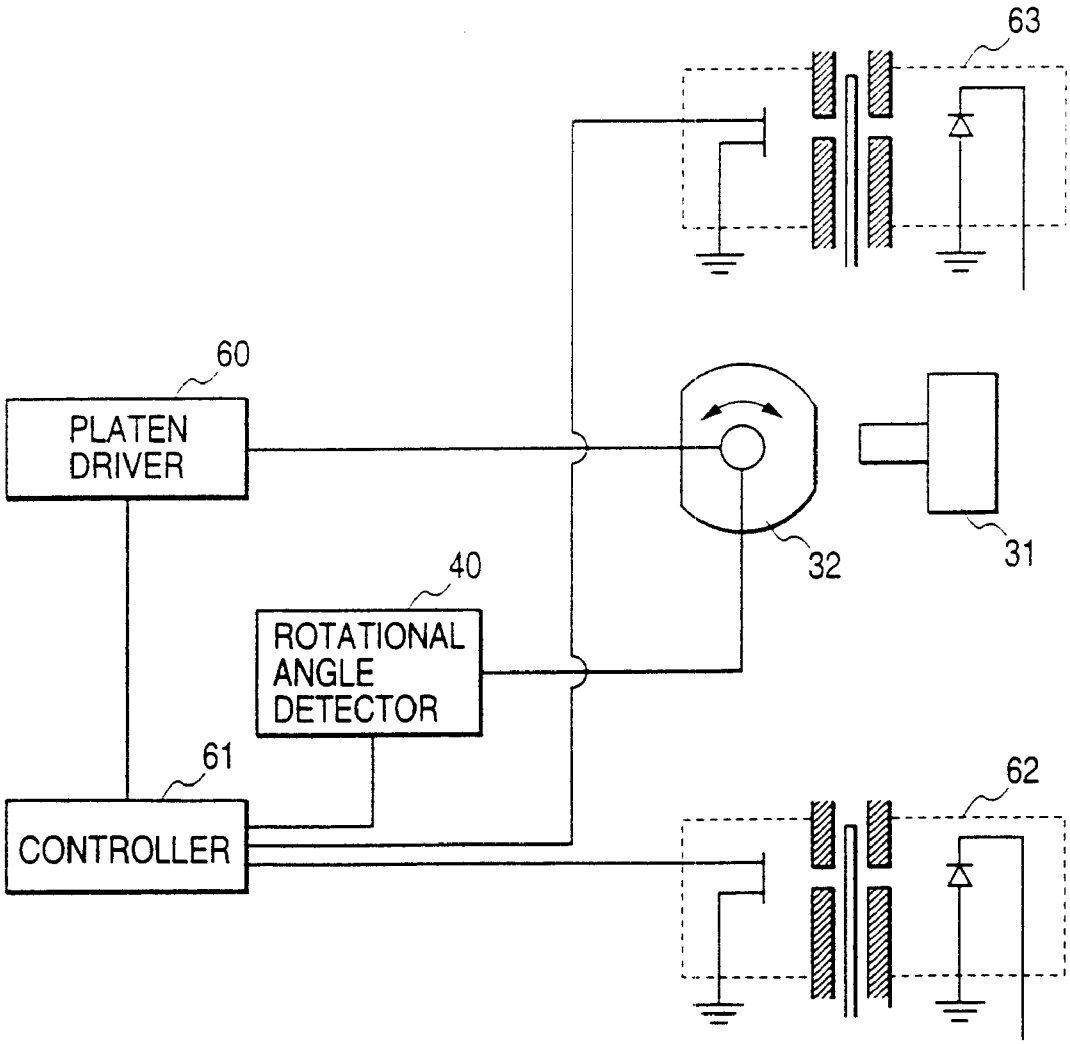
FIG. 6 illustrates a drive control circuit for platen operation.

Referring now to FIG. 6, a drive control circuit which drives the platen in the platen mechanism and controls the operation of the platen is illustrated. A platen driver unit 60 drives the platen 32 to turn so as to selectively position either one of the support surface 36 and the guide surface 37 of the platen 32 confronting the print head 31. A control unit 61 receives signals from a first sheet-edge sensor 62 corresponding to the first sheet sensor 6 shown in FIG. 2 attached upstream in the sheet transporting direction in the second printing unit 30, a second sheet-edge sensor 63 corresponding the second sheet sensor 7 shown in FIG. 2 attached downstream, and the rotation angle detector 40, and controls the platen driver unit 60 in accordance with those signals received. When the first sheet-edge sensor 62 detects the check sheet P moving through the first transport path, the control unit 61 reads a signal derived from the rotation angle detector 40. When the support surface 36 of the platen 32 confronts the print head 31, the control unit 61 controls the platen drive unit 60 so that the platen 32 is turned 180 degrees to confront the guide surface 37 with the print head 31. As the result of the control, the platen 32 is retracted from the first transport path to allow the check sheet P to be smoothly advanced through the printing region of the second printing unit 30. When a check sheet P is set at a predetermined location in the printing region of the second printing unit 30, the second sheet-edge sensor 63 senses the check sheet P, and sends a detecting signal to the control unit 61. In response to the received signal, the control unit 61 controls the platen driver unit 60 so that it turns the platen 32 a predetermined angle (180 degrees in this embodiment) and the support surface 36 confronts the print head. In this state, the second printing unit 30 (FIG. 2) is ready for printing on the check sheet P.

Figure 7:
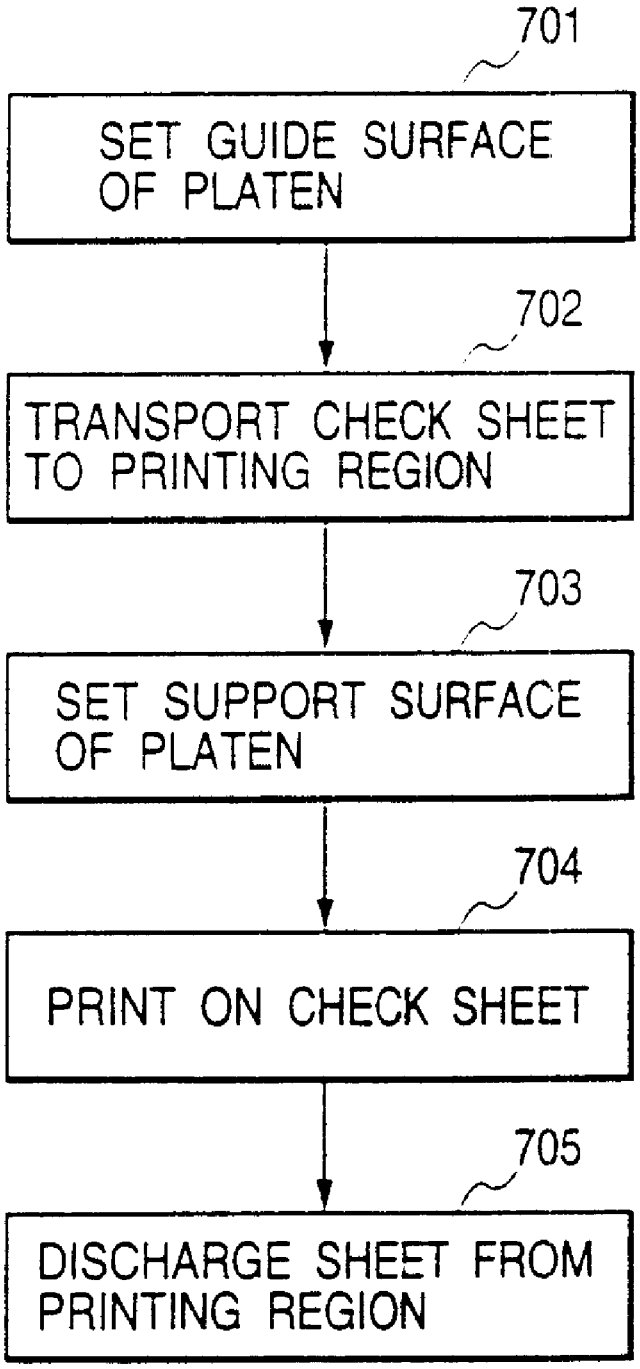
FIG. 7 illustrates a flow chart of a control procedure in the second printing unit.
Figure 8:
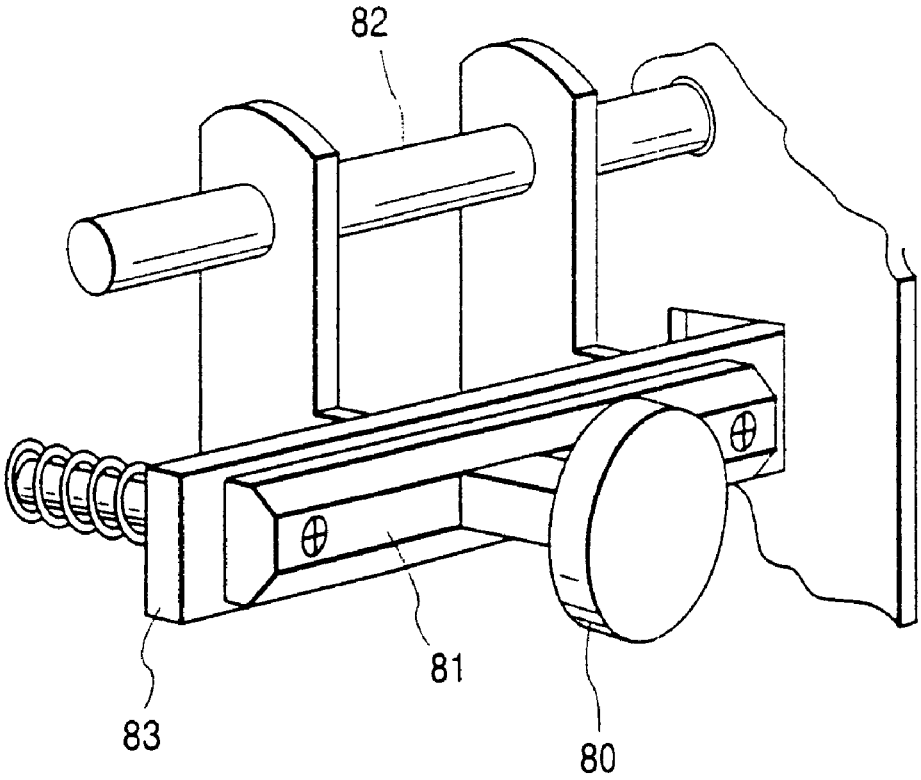
FIG. 8 (PRIOR ART)
FIG. 8 illustrates a perspective view of a conventional, prior art platen mechanism in a printing device.
Figure 9:
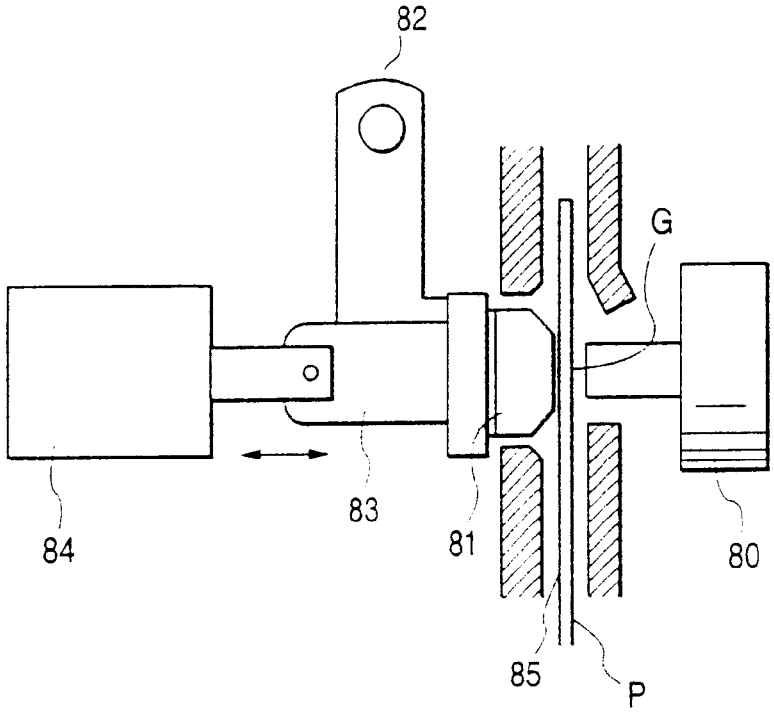
FIG. 9 (PRIOR ART)
FIG. 9 illustrates a side view of the platen mechanism of FIG. 8 when it is in a print mode.
Figure 10:
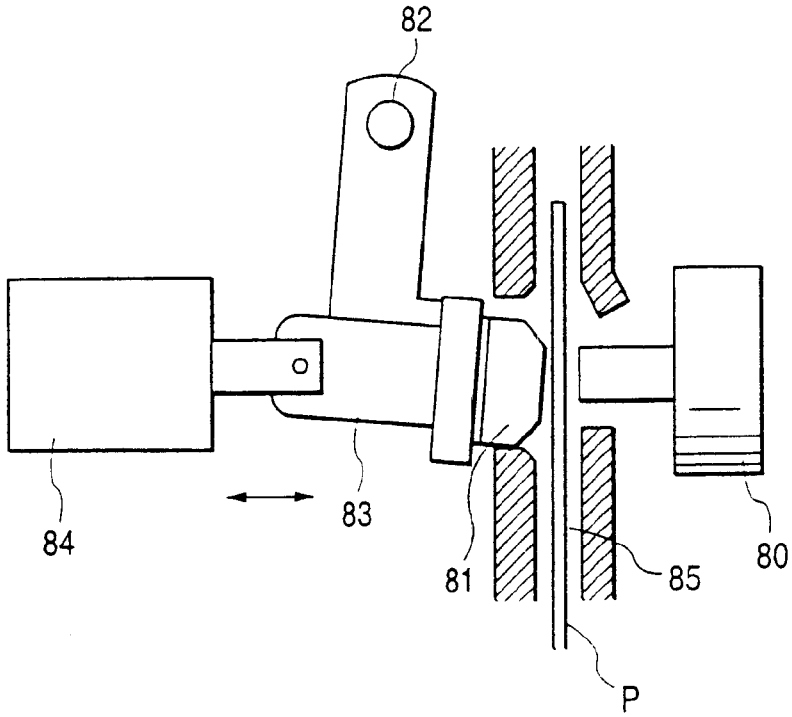
FIG. 10 (PRIOR ART)
FIG. 10 illustrates a side view of the platen mechanism of FIGS. 8 and 9 in a sheet insertion mode.

Referring now to FIG. 7, a flow chart showing a control procedure in the second printing unit is illustrated. A check sheet P is inserted into the first transport path 10. The platen 32 is turned to confront the guide surface 37 thereof with the print head 31 (step 701). The check sheet P is transported to the second printing unit 30 by means of the first roller pair 12, and set at a print location (step 702). When it is detected by the second sheet edge detector that the check sheet P is properly set, the platen 32 is turned 180 degrees, and the support surface 36 confronts the print head 31 (step 703). In this state, the second printing unit 30 starts to print on the check sheet P (step 704). The second printing unit 30 completes its printing on the check sheet P, and the check sheet P is discharged out of the second printing unit 30 by means of the second roller pair 13 (step 705).

Figure 16:
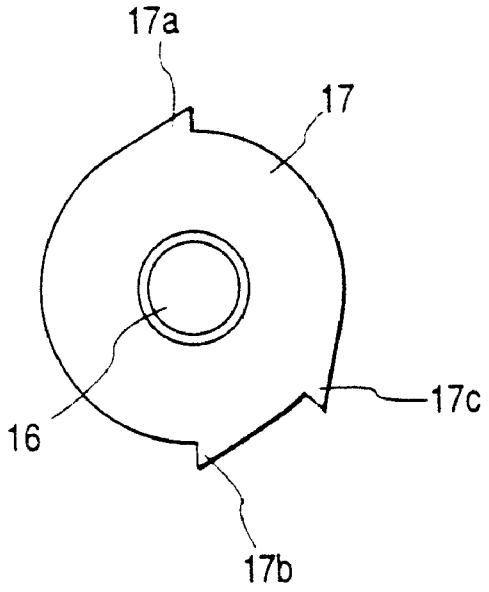
FIG. 16 illustrates a side view of a clutch wheel of the clutch mechanism of FIG. 15.

Referring now to FIG. 11, a sectional view showing another platen drive mechanism embodying the present invention is illustrated. A plane having the same structure as is already described is included in the platen drive mechanism. A gear 35 is coupled to the shaft 32*a* of the platen 32. The gear 35 is in mesh with a transmission gear 19 engaging with a clutch gear 18. When the clutch gear 18 is coupled to a drive shaft 16, a drive force generated by the drive shaft 16 is transmitted to the platen 32, through a gear train of the clutch gear 18, the transmission gear 19 and the gear 35. A trigger plunger 15 is provided for coupling or decoupling the clutch gear 18 to or from drive shaft 16. When the trigger plunger 15 is placed to an attraction state, a trigger lever 15*a* is disengaged from a ratchet wheel 17, and the clutch gear 18 is coupled to the drive shaft 16. When the trigger plunger 15 is placed to a non-attractive state, the trigger lever 15*a* is set free to be caused by a compression spring 15*b* to engage with a pawl 17*a*, 17*b* or 17*c* (FIG. 16) of the ratchet wheel 17, and the clutch great 18 is coupled from the drive shaft 16.

Figure 15:
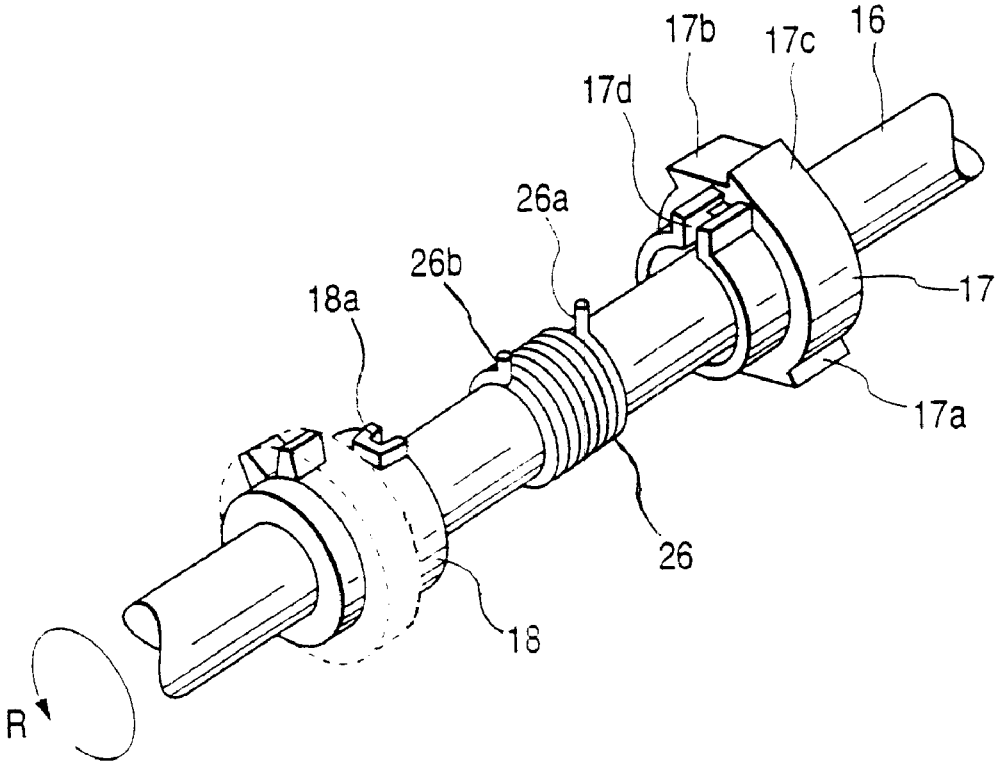
FIG. 15 illustrates a perspective view of a clutch mechanism in the platen drive mechanism of FIG. 11.

Referring now to FIG. 15, a perspective view showing the clutch mechanism in the platen drive mechanism is described. A clutch spring 26 is closely would around the drive shaft 16 when no external force acts on it. The drive shaft 16 is rotatably and slidably inserted into the clutch gear 18 and the ratchet wheel 17. Those component parts of the clutch mechanism are assembled such that one end (first end) 26*a* of the clutch spring 26 is inserted into a groove 17*d* of the ratchet wheel 17, and the other end (second end) 26*b* is inserted into a groove 18*a* of the clutch gear 18.

The operation of the clutch mechanism will be described. It is assumed that the drive shaft 16 is rotating in the direction of an arrow R. When the trigger lever 15*a* engages with one of the clutch pawls of the ratchet wheel 17, the clutch spring 26 receives at its first end 26*a* a force from the groove 17*d* of the ratchet wheel 17 (the force has the direction opposite to the direction R, i.e., the direction in which the clutch spring 26 is unwound). Under this condition, the inside diameter of the clutch spring 26 is increased, loses its frictional force to the drive shaft 16, and idly rotates with respect to the drive shaft 16. Accordingly, the clutch gear 18 engaging with the clutch spring 26 also stops, and idly rotates with respect to the drive shaft 16. When the trigger lever 15*a* is disengaged from the clutch pawl, the clutch spring 26 regains its frictional force to the drive shaft 16, and rotates together with the drive shaft 16. At this time, when a load torque, of which the direction is opposite to the direction R, acts on the clutch gear 18, the groove 18*a* of the clutch gear 18 applies a force to the second end 26*b* of the clutch spring 26. Then the force further tightens the clutch spring 26 around the drive shaft 16. As a result, the frictional force between the drive shaft 16 and the clutch spring 26 is increased, and the drive shaft 16 transmits to the clutch gear 18 a drive force which acts to turn the clutch gear 18 while resisting the load Thus, the clutch spring 26 slidably moves on and to the drive shaft 16. In this respect, it is desirable to configure the clutch spring 26 so that it is highly wear proof. A spring formed by coiling a wire, rectangular in cross section, many turns and side by side, is preferably used for the clutch spring 26. The coil is preferably impregnated with lubricant oil.

A reduction ratio of the clutch gear 18 to the platen 32 is 1. The ratchet wheel 17 is provided with the pawls 17*a* and 17*b*, which correspond to the position where the support surface 36 of the platen 32 confronts the print head 31, and the position where the guide surface 37 confronts the print head 31. Specifically, when the trigger lever 15*a* comes in engagement with the pawl 17*a*, the support surface 36 confronts the print head 31. When it is brought into engagement with the pawl 17*b*, the guide surface 37 confronts the print head 31.

The pawl 17*c* of the ratchet wheel 17 is used to determine an initial position of the platen 32. Reliable engagement of the pawl 17*a* with the trigger lever 15*a* is secured by controlling the current feeding time to the trigger plunger 15 in the following procedure. After powered on, the drive shaft is turned on by a predetermined quantity of turn to initially engage one of the pawls 17*a* to 17*c* with the trigger lever 15*a*, and current is fed to the trigger plunger 15 for a time period somewhat longer than a time taken for the trigger ratchet wheel to turn half. After the time period elapses, the trigger lever 15*a* is brought into engagement with the pawl 17*c* when it has initially engaged with the pawl 17*a*, and the pawl 17*b* when it has initially engaged with the pawl 17*b* or 17*c*. Thereafter, current is fed to the trigger plunger 15 for a time period subtly longer than at time for the ratchet wheel to turn over an angular range from the pawl 17*b* to the pawl 17*c*. As the result of the current feeding, the pawl 17*a* is reliably brought into engagement with the trigger lever 15*a*. The current feeding time may be a time obtained in advance through measurement. However, the current feeding time is preferably determined in a manner than a quantity of rotation of the drive shaft is detected. The proper current feeding time is determined on the basis of the detected rotation quantity. With this current feeding time, it is possible to avoid adverse effects by a variation of load to the drive shaft and a variation of the drive voltage. The rotation angle detector 40 may be preferably applied for detecting the rotation quantity of the drive shaft.

When the clutch gear 18 is coupled to or decoupled from the drive shaft 16, the clutch spring 26 is somewhat deformed. Therefore, a rotational phase error is caused between the ratchet wheel 18 and the clutch gear 18 or the platen 32. In this respect, the platen 32, having the guide surface shaped as shown in FIG. 12, is preferably used for the platen drive mechanism incorporating the clutch mechanism thus constructed. Further, the shuttle spring head which is insensitive to an angular displacement of the cylinder shaped support surface is preferable in this embodiment.

Returning to FIG. 11, the transmission gear 19 is in mesh with a cam gear 21. The cam gear 21 includes a cam part 21*a* located such that a cam follower part 25*a* of a sub frame 25 is brought into contact with the cam part 21*a*. One of the paired rollers 13 is attached to the sub frame 25. In this cam mechanism, when the cam gear 21 is turned, the cam part 21*a* comes in contact with the cam follower part 25*a*, the sub frame 25 is turned about a fulcrum 24 while resisting a compression coil spring 22, and the roller 13*b* of the roller pair 13 is shifted to the right in the drawing while moving away from the roller 13*a* of the roller pair. As a result, a satisfactory sheet path for the check sheet P is secured in a region located downstream of the platen 32 in the sheet transporting direction. The number of teeth of the gear 35 is equal to that of the cam gear 21. The platen 32 and the cam part 21*a* of the cam gear 21 are turned in phase. The roller 13*b* of the roller pair 13 is positioned most apart from the roller 13*b* when the guide surface 37 of the platen 32 confronts the print head 31. At this time, a platen 23 of the first printing unit 4 is positioned most apart from the first printing unit 4, to secure a sheet transport path large enough to pass the sheet P therethrough.

A magnetic head 3 for reading MICR characters and a presser member 3*a* for pressing a check sheet P against the information reading unit 3 to reduce read errors are provided in the vicinity of the inlet port 11 for the check sheet P. The roller pair 12 is used for transporting the check sheet P for the reading of MICR characters by the magnetic head 3.

A hardware scheme for controlling the platen drive mechanism and a method of controlling the same will be described with reference to FIGS. 17 and 18.

Figure 17:
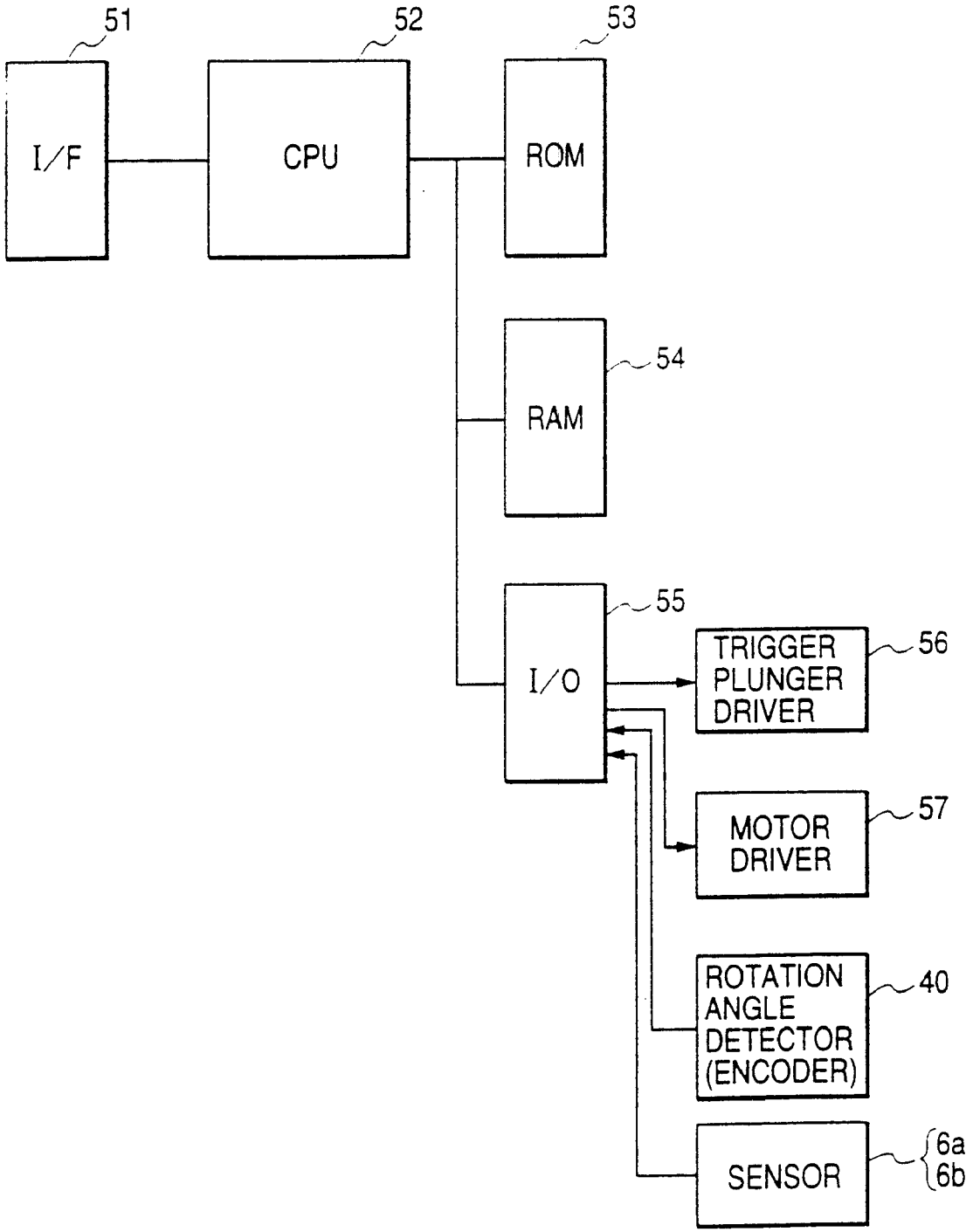
FIG. 17 illustrates a block diagram of a hardware scheme for controlling a platen drive mechanism of FIG. 11.

FIG. 17 shows the hardware scheme in the form of a block diagram. An interface 51 physically and logically connects the multi-functional imaging apparatus 1 and a host computer (not shown). The interface 51 includes at least a drive for an interface signal, a receiver, and an UART (Universal Asynchronous Receiver Transmitter) circuit for receiving serial data under a predetermined protocol. The data fetched, by the interface 51, from the host computer is processed by a central processing unit (CPU) 52 under control of a control program stored in a ROM 53. During the data processing, a RAM 54 is used as a storage for temporarily storing data. The CPU 52 sends various control signals, via an input/output circuit 55, to such control objects as a driver 56 for the trigger plunger 15, and a driver 57 for driving motors (not shown) as a drive source for the drive shaft 16. The CPU also receives through the input/output circuit 55 signals representative of states of various portions in the printing unit, such as an encoder pulse signal representative of a rotation quantity of the drive shaft 16, and a state of the first sheet-edge sensor 6. The input/output circuit 55 includes at least a voltage converting circuit for the logic circuit and the drive circuit, and a timing converting circuit, e.g., a latch circuit for the synchronization with the operation of the CPU 52. The trigger plunger driver 56 and the driver 57 include at least power transistors and surge absorption diodes.

Figure 18:
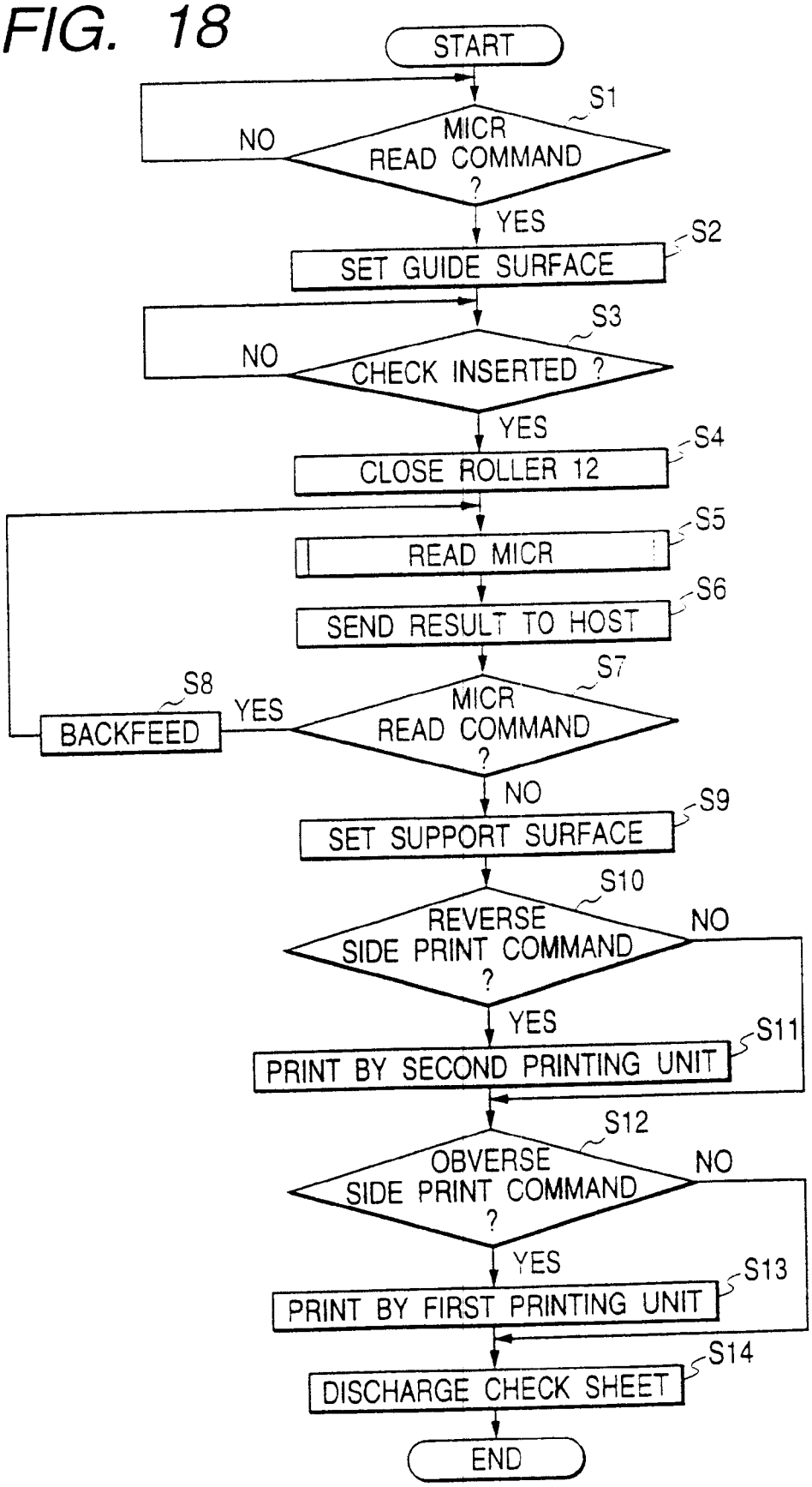
FIG. 18 illustrates a flow chart of a software scheme for controlling a platen drive mechanism.

FIG. 18 is a flow chart showing a method for controlling the platen 32 in the platen drive mechanism. A procedure of the control method is stored, in the form of a control program for the CPU 52, in the ROM 53. After powered on, the CPU 52 initializes the platen drive mechanism and analyzes data from the host computer to detect a "MICR read command" (step S1). If the command is detected, the CPU 52 outputs a drive signal of a predetermined length, via the input/output circuit 55, to the trigger plunger driver 56 which in turn confronts the guide surface 37 of the platen 32 with the print head 31 (step S2). The predetermined length of the drive signal is obtained by counting the pulses derived from the rotation angle detector 40. The number of pulses generated by the encoder while the ratchet wheel 17 turns from the pawl 17*b* to the pawl 17*c* is know. Therefore, the output of the drive signal in the step S2 is continued until a value of the counter (not shown) for counting the encoder pulses exceeds the above known number. As a result, a reliable turn of the clutch gear, or the platen 32, from the pawl 17*a* to the pawl 17*b* and vice versa is secured.

Whether or not a check sheet P is inserted by use of out output signal of the first sheet-edge sensor 6 (step S3). Note that in the mechanism of the present embodiment, the first sheet-edge sensor 6 includes a trailing edge sensor 6*a* and a leading edge sensor 6*b* as shown in FIG. 11 to confirm that the check sheet is properly inserted into the mechanism. The controller judges the insertion of the check sheet P when both sensors 6*a* and 6*b* detect presence of an object. If the check sheet P is inserted, the CPU 52 closes the first roller pair 12 located near the inlet port by energizing a plunger solenoid through a drive circuit both not shown. The check sheet P is then nipped by the paired rollers 12 for its transportation (step S4). The information reading unit 3 reads MICRO characters on the check sheet P being transported at high constant speed (step S5). In this case, it is preferable to drive the actuator (not shown) to press the check sheet P against the information reading unit 3 during the reading operation.

After the reading operation, the CPU 52 sends the result of the reading to the hose computer by way of the interface 51 (step S6). The host computer analyzes the readout result, and if the re-reading of the MICR characters is required in case of, for example, a decoding error, sends a re-read command to the multi-functional imaging apparatus 1. In response to the re-read command (step S7), the CPU 52 in the multi-functional imaging apparatus 1 feeds the check sheet P backward to the start position with releasing the presser (step S8), and reads the MICR characters again (step S5).

After the reading or re-reading operation, if the CPU 52 receives a print command from the host computer, it confronts the support surface 36 of the platen 32 with the print head (step S9), and prepares for the printing of the obverse and the reverse sides of the check sheet P. In accordance with the contents of the command received, the corresponding printing unit is selected (steps S10, S12) and operated for printing (steps S11, S13), and the printed sheet is discharged from the printing unit. After the reverse side printing, the CPU 52 judges if the obverse side printing is required, on the basis of the command from the host.

In the embodiments mentioned above, the flat surface is used for the support surface 36 of the platen 32. If required, the outer circumferential surface of the cylindrical platen 32 may directly be used for the support surface 36. The guide surface 37 of the platen 32 is also flat in the above-mentioned embodiments. It is designed as to be preferably continuous to the first transport path 10 adjoining to the second printing unit 30, when the first transport path is curbed, it is desirable to make the guide surface 37 be curved to form a continuous paper guide. The support surface 36 and the guide surface 37 are angularly spaced 180 degrees from each other in the above-mentioned embodiments. If necessary, those surfaces may be angularly spaced a proper angle.

The platen 32 is formed with a single solid body. In an alternation, a support portion including the supporting surface, a guide portion including the guide surface, and an introducing portion including the introducing surface are separate members, and those members are combined to form a platen.

In the embodiments mentioned above, the present invention is applied to the check sheet processing apparatus for processing a check sheet bearing MICR characters printed thereon. It is evident that the invention is applicable to other apparatus, for example, an apparatus for reading information from a recording medium by use of an OCR with the fixed detector and a bar code reader, an apparatus for printing a recording medium with a magnetic tape attached thereonto, etc.

While some specific embodiments of the present invention have been described in detail with reference to the accompanying drawings, it should be understood that the invention is not limited to those embodiments, but may variously be modified, changed and altered within the true spirits of the invention.

What is claimed is:

1. A printing device comprising:

a print head for printing on a recording medium;

a detector for reading information on the recording medium;

a sheet transporting mechanism to transport the recording medium past said print head and said detector;

a guide wall for guiding the recording medium transported by said transporting mechanism to said print head;

a platen confronting said print head and disposed so as to be movable to a first position where said platen is projected from said guide wall to support the recording medium to said print head, and to a second position where said platen is substantially continuous to said guide wall to smoothly guide the recording medium;

a platen drive mechanism for driving said platen to selectively move to one of said first and second positions;

a controller to selective control said platen drive mechanism so as to:

(1) move said platen to said first position at least when printing by said print head, and (2) move said platen to said second position at least when reading the information by said detector; and a command interpreter to interpret a control command received from a host device connected to said printing device, wherein said controller controls said platen drive mechanism to move said platen to said second position at least when said command interpreter interprets a predetermined command requiring said detector to read the information.

2. A printing device according to claim 1, wherein said platen is rotatably provided about a shaft which extends substantially in parallel to said guide wall, and comprises:

a support member projected from said guide wall and confronting the print head to support the recording medium to said print head when said platen is at a first rotational position forming said first position; and a guide member substantially continuous to said guide wall to smoothly guide the recording medium when said platen is at a second rotational position forming said second position.

3. A printing device according to claim 1, further comprising:

an urging member which urges the recording medium apart from said print head and supports the recording medium at a predetermined distance from said print head in cooperation with said platen, wherein said platen is positioned apart from said urging member when said platen is at the second position.

4. A printing device according to claim 1, wherein at said second position, said platen matches at least one end of said guide wall.

5. A printing device according to claim 1, wherein said platen includes an introducing surface for introducing the recording medium from an end of said guide wall to said print head at said first position.

6. A printing device according to claim 1, wherein said detector comprises a magnetic head for reading MICR (magnetic ink character recognition) characters imprinted on the recording medium.

7. A printing device comprising:

a print head for printing on a recording medium;

a detector for reading information on the recording medium;

a sheet transporting mechanism to transport the recording medium past said print head and said detector;

a guide wall for guiding the recording medium transported by said transporting mechanism to said print head;

a platen confronting said print head and disposed so as to be movable to a first position where said platen is projected from said guide wall to support the recording medium to said print head, and to a second position where said platen is substantially continuous to said guide wall to smoothly guide the recording medium;

a platen drive mechanism for driving said platen to selectively move to one of said first and second positions;

a controller to selective control said platen drive mechanism so as to:

(1) move said platen to said first position at least when printing by said print head, and (2) move said platen to said second position at least when reading the information by said detector;

a pair of rollers for transporting the recording medium when said print head prints on the recording medium;

a roller-pair drive to move said pair of rollers to and from each other; and an interlinking mechanism to mechanically link said platen drive mechanism to said roller-pair drive such that when said platen drive mechanism moves said platen to said first position, said roller-pair drive moves said pair of rollers to bring them into contact with each other, and when said platen drive mechanism moves said platen to said second position, said roller-pair drive moves said pair of rollers apart from each other.

8. A printing device according to claim 7, wherein said platen is rotatably provided about a shaft which extends substantially in parallel to said guide wall, and comprises:

a support member projected from said guide wall and confronting the print head to support the recording medium to said print head when said platen is at a first rotational position forming said first position; and a guide member substantially continuous to said guide wall to smoothly guide the recording medium when said platen is at a second rotational position forming said second position.

9. A printing device according to claim 7, further comprising:

an urging member which urges the recording medium apart from said print head and supports the recording medium at a predetermined distance from said print head in cooperation with said platen, wherein said platen is positioned apart from said urging member when said paten is at the second position.

10. A printing device according to claim 7, wherein at said second position, said platen matches at least one end of said guide wall.

11. A printing device according to claim 7, wherein said platen includes an introducing surface for introducing the recording medium from an end of said guide wall to said print head at said first position.

12. A printing device according to claim 7, wherein said detector comprises a magnetic head for reading MICR (magnetic ink character recognition) characters imprinted on the recording medium.

13. A printing device comprising:

a print head for printing on a recording medium;

a detector for reading information on the recording medium;

a sheet transporting mechanism to transport the recording medium past said print head and said detector;

a guide wall for guiding the recording medium transported by said transporting mechanism to said print head;

a platen confronting said print head and disposed so as to be movable to a first position where said platen is projected from said guide wall to support the recording medium to said print head, and to a second position where said platen is substantially continuous to said guide wall to smoothly guide the recording medium;

a platen drive mechanism for driving said platen to selectively move to one of said first and second positions; and a controller to selectively control said platen drive mechanism so as to:

(1) move said platen to said first position at least when printing by said print head, and (2) move said platen to said second position at least when reading the information by said detector, wherein said platen drive mechanism comprises:

a drive shaft;

a clutch mechanism to transmit, when in a coupling state, a drive force from said drive shaft to said platen, and a trigger mechanism to selectively set up a coupling state of said clutch mechanism, and a decoupling state of said clutch mechanism in accordance with a predetermined amount of rotation of said platen.

14. A printing device according to claim 13, wherein said platen is rotatably provided about a shaft which extends substantially in parallel to said guide wall, and comprises:

a support member projected from said guide wall and confronting the print head to support the recording medium to said print head when said platen is at a first rotational position forming said first position; and a guide member substantially continuous to said guide wall to smoothly guide the recording medium when said platen is at a second rotational position forming said second position.

15. A printing device according to claim 13, further comprising:

an urging member which urges the recording medium apart from said print head and supports the recording medium at a predetermined distance from said print head in cooperation with said platen, wherein said platen is positioned apart from said urging member when said platen is at the second position.

16. A printing device according to claim 13, wherein at said second position, said platen matches at least one end of said guide wall.

17. A printing device according to claim 13, wherein said platen includes an introducing surface for introducing the recording medium from an end of said guide wall to said print head at said first position.

18. A printing device according to claim 13, wherein said detector comprises a magnetic head for reading MICR (magnetic ink character recognition) characters imprinted on the recording medium.

* * * * *